United States Patent [19]

Jones

[11] Patent Number: 4,577,754

[45] Date of Patent: Mar. 25, 1986

[54] NAIL CLIPPINGS RECEPTACLE

[76] Inventor: Joyce D. Jones, 9056 King Dr., Chicago, Ill. 60619

[21] Appl. No.: 573,151

[22] Filed: Jan. 23, 1984

[51] Int. Cl.[4] ..... A45C 11/26

[52] U.S. Cl. ..... 206/349

[58] Field of Search ..... 206/349, 362.1, 362.3, 206/362.4

[56] References Cited

U.S. PATENT DOCUMENTS 4,322,002 3/1982 Itea .

*Primary Examiner*—Joseph Man-Fu Moy

[57] ABSTRACT

The invention herein disclosed consists of a means of collecting severed nail portions for later disposal through the use of a receptacle which may be attached to and removed from any conventional nail clipper.

5 Claims, 5 Drawing Figures

NAIL CLIPPINGS RECEPTACLE

This invention consists of an attachment to be used with any conventional nail clipper; its object being to contain an accumulation of severed nail portions, as they are cut off, for later disposal.

The conventional nail clipper has been known and widely used for many years. It consists of a pair of blades with cutting edges on one end thereof, the other ends being firmly fastened together by suitable means. The blades of the clipper are wider at the end where the cutting edges are located, this width being standard among conventional clippers.

Normally, the cutting edges are held apart due to the spring action of the blades, but may be brought together through the use of an attached lever. This lever may be placed in an inoperative position lying along the top blade, or may be placed in its operating position in which one end projects upwardly and may be depressed, causing the cutting edges to come together and clip the nail.

The width of the blades and the lever appendage are the only two features that are standard on conventional nail clippers. The shape and size of the narrow end vary. There are also various means of fastening the blades together at the narrow end. Some clippers have a nail file attachment at this end. The invention described here allows for these differences and, unlike others, will adapt to any conventional clipper regardless of them.

When the nails are cut with a conventional type nail clipper, the severed nail portions are allowed to fly about and drop to the floor leaving the possibility of eye injury and a considerable mess. Also, the blades of the clipper are likely to grow dull with extended use. The present invention allows the replacement of a dull clipper without the added expense of a new receptacle. Presently, there exists no means of collecting severed nail portions which will service any conventional nail clipper regardless of the size, shape, and means of fastening of its narrow end. Further, there exists no clippings receptacle which is not an integral part of a particular clipper.

It is, therefore, an object of the present invention to provide a nail clippings receptacle which may be used with any conventional nail clipper.

Another object is to provide means for storing nail clippings as they are cut for later disposal.

In accordance with the present invention, these and other objects are achieved by providing a removable receptacle which may be attached to any conventional nail clipper.

The novel characteristics and objectives of the invention will be more readily apparent in view of the following description and accompanying drawing, where:

Figure 1:
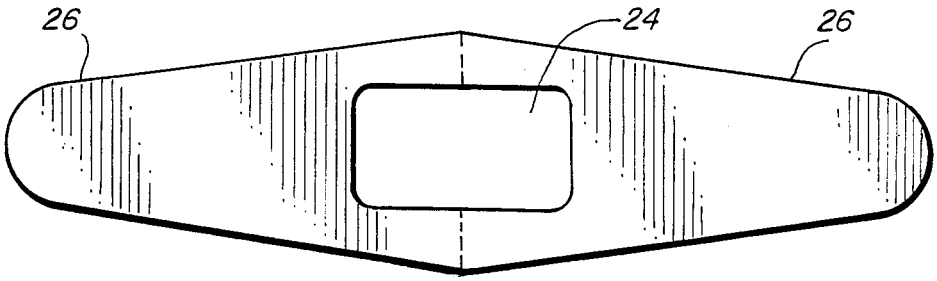
FIG. 1 is a plan view of the clippings receptacle before it is assembled.

Referring to the drawing, the conventional nail clipper has a top blade (2) and a bottom blade (4) arranged approximately parallel to each other, each having a narrow end fastened together by suitable means. At their opposite ends the blades have inwardly extending, curved cutting edges. The top blade (2) having a cutting edge (6) and the bottom blade (4) having a cutting edge (8). Each blade has a small perforation near the cutting edge through which a rivet pin passes (10). This pin (10) consists of a bottom cap (12) in contact with the lower surface of the bottom blade (4) and an upper end which extends above the upper surface of the top blade (2). The rivet pin (10) has a transverse slot (16) which pivotally supports a lever (18) which rests on the upper surface of the top blade (2). The lever (18) has a tapered end upon which pressure may be exerted in order to bring the blades together, thereby causing the cutting action.

Figure 2:
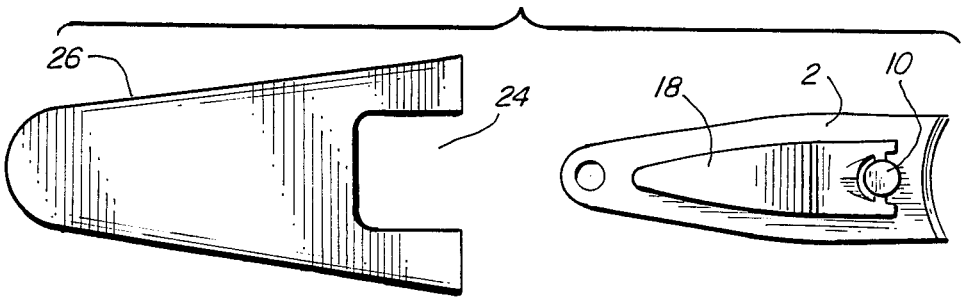
FIG. 2 is an exploded view of the assembled receptacle with a conventional nail clipper.
Figure 3:
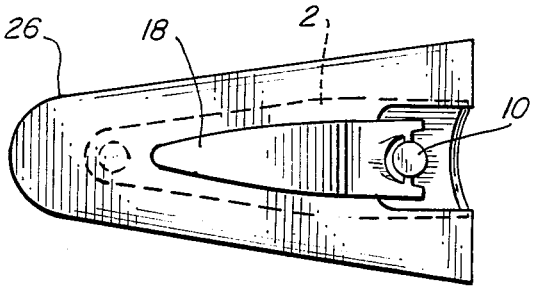
FIG. 3 is a plan view of the receptacle when attached to a conventional nail clipper.
Figure 5:
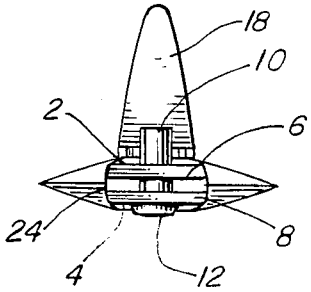
FIG. 5 is a front elevational view of FIG. 3.
Figure 4:
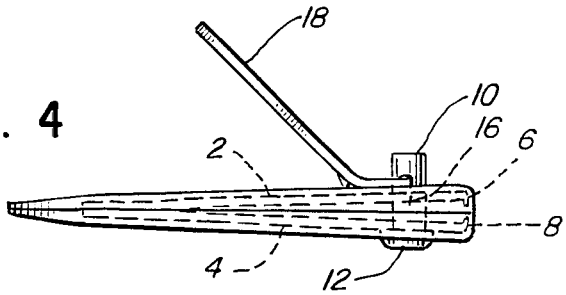
FIG. 4 is a side elevational view of FIG. 3.

The invention consists of a piece of flexible material, such as plastic, cut into a form such as that shown in FIG. 1 with a perforation (24) at the center to accommodate the nail clipper. When folded at the center along the broken line shown in FIG. 1, and secured along the edges (26) by suitable means such as sewing or bonding, a flexible pouch-like article is formed as shown in FIG. 2. This pouch-like article comprises a nail clippings receptacle which may be attached to, or removed from any conventional nail clipper as described above. This may be accomplished by putting the clipper into its operating position with the lever extended upwards, and sliding the body of the clipper into the perforation (24) provided at the top of the receptacle. This leaves the lever free for operation. When the receptacle is in place, it is held securely there by the perforation (24) which fits snugly around the cutting edges (6 and 8). The clipper is prevented from sliding into the receptacle by the blockage incurred where the lever (18) rests against the top blade (2). The light weight of the receptacle assists it in staying in place. The cutting edges are exposed by the perforation (24) at the top of the receptacle as shown in FIG. 5, allowing the nail to be inserted unobstrusively for clipping. The clippings are contained by the receptacle, which may be slidably removed from the clipper in order to permit the emptying of an accumulation of clippings through the perforation (24) at the top of the receptacle. When not in use the clipper may be stored in the receptacle by putting the lever into its inoperative position on the outside of the receptacle.

The pouch-like article comprising the receptacle may also be formed by two pieces of material which together would comprise an elongated piece such as that shown in FIG. 1.

Although a preferred embodiment of the invention has been shown and described in detail here to illustrate the novelty and uses of the inventive principles, it is to be understood that the invention is not to be limited to the details of this construction and may be embodied otherwise.

I claim:

1. A nail clipping receptacle for use with a nail clipper having a pair of opposed blades, each of said blades having a cutting edge opposed to the other cutting edge, a pin extending through the blades, and a lever connected to the pin for selectively moving the cutting edges toward each other for cutting nails; said receptacle comprising a pouch having a continuous top, and a continuous bottom, said top having a plurality of top edges, said bottom having a plurality of bottom edges defining a shape similar to a shape defined by the top edges, said top edges being sealingly fixed to like bottom edges to form continuous edges of the pouch, said pouch having an opening for receiving said nail clipper, said opening extending into the top, said nail clipper positionable in the opening with the cutting edges of the clipper being substantially aligned with a junction of the top and the bottom to allow positioning of a nail between the cutting edges for cutting the nail.

2. A nail clipping receptacle as defined in claim 1, wherein said pouch is a single piece of flexible material being folded to form an edge having the opening on the fold.

3. A nail clipping receptacle as defined in claim 1, wherein the pin of the nail clipper is engageable with a portion of the periphery of the opening to hold the nail clipper relative to the receptacle.

4. A nail clipping receptacle as defined in claim 1, wherein the outer shape of the receptacle is similar in outer shape of the nail clipper.

5. A nail clipping receptacle as defined in claim 1, wherein said pouch is a single piece of flexible material being folded to form an edge having the opening on the fold, said pin of the nail clipper is engageable with a portion of the periphery of the opening to hold the nail clipper relative to the receptacle, and the outer shape of the receptacle is similar to the outer shape of the nail clipper.

* * * * *